US011649797B2

(12) United States Patent
Bankovsky

(10) Patent No.: US 11,649,797 B2
(45) Date of Patent: May 16, 2023

(54) WATERPOWER STREAM AMPLIFIER DEVICE

(71) Applicant: Boris Bankovsky, Walthem, MA (US)

(72) Inventor: Boris Bankovsky, Walthem, MA (US)

( * ) Notice: Subject to any disclaimer, the term of this patent is extended or adjusted under 35 U.S.C. 154(b) by 0 days.

(21) Appl. No.: 17/844,866

(22) Filed: Jun. 21, 2022

(65) Prior Publication Data

US 2022/0412300 A1 Dec. 29, 2022

Related U.S. Application Data

(60) Provisional application No. 63/216,198, filed on Jun. 29, 2021.

(51) Int. Cl.
*F01B 23/00* (2006.01)
*F03B 3/12* (2006.01)

(52) U.S. Cl.
CPC ..... *F03B 3/126* (2013.01); *F05B 2240/24* (2013.01); *F05B 2250/232* (2013.01)

(58) Field of Classification Search
CPC ..... F15D 1/04; F15D 1/0015; F05B 2240/97; F05B 2210/16; F03B 13/264
USPC ..... 416/54
See application file for complete search history.

(56) References Cited

U.S. PATENT DOCUMENTS 10,302,104 B2 * 5/2019 Schmidt ..... F15D 1/02
11,378,110 B1 * 7/2022 Schmidt ..... F15D 1/02

* cited by examiner

*Primary Examiner* — Long T Tran
*Assistant Examiner* — James J Kim
(74) *Attorney, Agent, or Firm* — Brennan, Manna & Diamond, LLC

(57) ABSTRACT

The present invention relates to a waterpower stream amplifier device primarily comprised of a body with an outer surface further comprised of at least one exterior protrusion and an interior surface further comprised of at least one angular flow director. The device can be placed/combined with the rotor of an underwater hydroelectric turbine in order to concentrate and multiple the energy of the water stream entering the turbine. The at least one angular flower director of the interior surface, the at least one exterior protrusions and at least one longitudinal opening of the outer surface allows water to enter the interior surface of the body from all directions. As a result, a rotating water vortex is created within the interior surface as the water travels from the first end towards the second end.

14 Claims, 4 Drawing Sheets

WATERPOWER STREAM AMPLIFIER DEVICE

CROSS-REFERENCE TO RELATED APPLICATION

The present application claims priority to, and the benefit of, U.S. Provisional Application No. 63/216,198, which was filed on Jun. 29, 2021, and is incorporated herein by reference in its entirety.

FIELD OF THE INVENTION

The present invention relates generally to the field of hydroelectric generators. More specifically, the present invention relates to a waterpower stream amplifier device primarily comprised of a body with an outer surface further comprised of at least one exterior protrusion and an interior surface further comprised of at least one angular flow director. The device can be placed in front of an underwater hydroelectric turbine in order to concentrate and multiply the energy of the water stream entering the turbine. The at least one angular flower director of the interior surface, the at least one exterior protrusion, and at least one longitudinal opening of the outer surface allows water to enter the interior surface of the body from all directions. As a result, a rotating water vortex is created within the interior surface as the water travels from the first end towards the second end. Accordingly, the present disclosure makes specific reference thereto. Nonetheless, it is to be appreciated that aspects of the present invention are also equally applicable to other like applications, devices and methods of manufacture.

BACKGROUND

Sources of renewable energy such as water are important for protecting the environment and further eliminating the use of fossil fuels. One type of renewable energy involves using water (such as but not limited to, ocean water) to power underwater hydroelectric turbines. However, this renewable energy source is impractical, as the power generated by said process is too small in scale, even in an industrial setting. This is due to the fact that underwater hydroelectric turbines are limited by a quadratic increase in the resistance to rotation with a linear increase in the size of the working surface of the rotors of the turbine. In addition, the power output of an underwater hydroelectric turbine also depends on the speed of water flow, which is not constant.

In an underwater hydroelectric turbine, the kinetic energy of water creates pressure on the surface area of the blades of the turbine. This pressure creates torque that rotates the turbine motor, which overcomes the resistance of the water and spins the turbine. The rotational speed of the turbine motor is further dependent on the ratio of torque and resistance generated by the force of water, wherein the magnitude of torque is determined by the kinetic energy of the water mass in the volume cut off by the sectional area of the rotating turbine blades and their width. However, since the high viscosity and resistance of water minimizes the area of the working surface of a turbine blade, the volume of the cut-off kinetic energy also decreases. As a result, underwater hydroelectric turbines are far less powerful than other renewable energy generators such as wind turbines. This is even despite the fact that the potential kinetic energy of water is significantly higher than wind.

Therefore, there exists a long-felt need in the art for a device that allows hydroelectric power to be used to its full power potential. There also exists a long-felt need in the art for a waterpower stream amplifier device that can be used to concentrate and multiply water stream energy in underwater hydroelectric turbine applications. Further, there exists a long-felt need in the art for a waterpower stream amplifier device that can be used to concentrate and multiply water stream energy in underwater hydroelectric turbine applications, wherein the device increases the scale and power capacity of underwater hydroelectric turbines.

The subject matter disclosed and claimed herein, in one embodiment thereof, comprises a waterpower stream amplifier device. The device is primarily comprised of a body with an outer surface further comprised of at least one exterior protrusion and an interior surface further comprised of at least one angular flow director. The device can be placed in front of an underwater hydroelectric turbine in order to concentrate and multiple the energy of the water stream by creating the large volume of rotated vortex of kinetic energy of water, that contacted to the blades of turbines rotor, and transmit over rotation the huge amount of kinetics energy to generator electricity. The at least one angular flower director of the interior surface, the at least one exterior protrusion, and at least one longitudinal opening of the outer surface allows water to enter the interior surface of the body from all directions. As a result, a rotating water vortex is created within the interior surface as the water travels from the first end towards the second end.

In this manner, the waterpower stream amplifier device of the present invention accomplishes all of the forgoing objectives and provides a device that allows hydroelectric power to be used to its full power potential. The device further concentrates and multiplies water stream energy in underwater hydroelectric turbine applications. Further, the device increases the scale and power capacity of underwater hydroelectric turbines.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a waterpower stream amplifier device. The device is primarily comprised of a body with an outer surface further comprised of at least one exterior protrusion and an interior surface further comprised of at least one angular flow director. The body is preferably generally conic-shaped, but may be any shape in differing embodiments such as, but not limited to, cylindrical, triangular, square, rectangular, etc.

The body is further comprised of at least one central inlet opening that runs from the first end to the second end of the body. The interior surface of the opening is further comprised of at least one angular flow director that may be arranged in a radial and/or spiral fashion around the interior surface. The angular flow director is preferably slightly curved and generally rectangular in shape. The director may further span the entire length of the interior surface. Once water enters the body through the opening, the flow director deflects water from horizontal movement in the direction of given rotation caused by the curvature of each flow director.

Water outside the body is further agitated as it passes over the outer surface of the body by at least one, but preferably a plurality of exterior protrusions which are preferably generally triangular in shape. The protrusions may be disposed radially or spirally along the entire outer surface, or may only be located on the top surface and bottom surface of the body. Any portion of the outer surface, but preferably the area of the outer surface near the base of each protrusion, is further comprised of at least one longitudinal opening that allows water to enter the interior surface of the body from all directions, thereby allowing water that is traveling outside of the body tangentially due to the protrusions to enter the body and transfer the momentum of flow into the interior surface. As a result, the direction of movement of the water is changed via the directors from longitudinal horizontal movement to transverse rotational movement, which forms a rotating water vortex within the interior surface as the water travels from the first end towards the second end.

Accordingly, the waterpower stream amplifier device of the present invention is particularly advantageous as it allows hydroelectric power to be used to its full power potential by concentrating and multiplying water stream energy in underwater hydroelectric turbine applications. In doing so, the device increases the scale and power capacity of underwater hydroelectric turbines. In this manner, the waterpower stream amplifier device overcomes the limitations of existing hydroelectric power generator methods known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
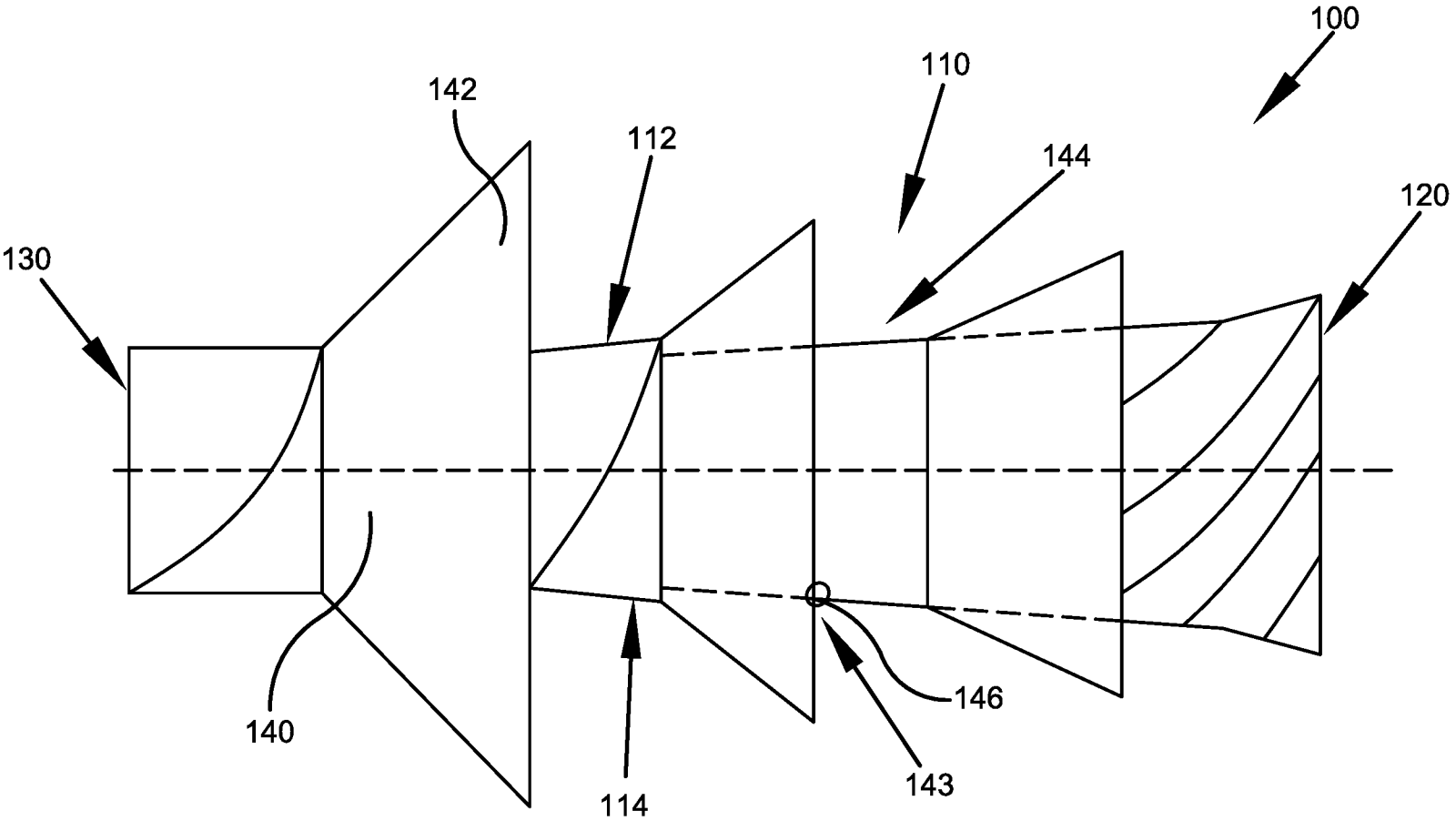
FIG. 1 illustrates a side view of one potential embodiment of a waterpower stream amplifier device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a device that allows hydroelectric power to be used to its full power potential. There also exists a long-felt need in the art for a waterpower stream amplifier device that can be used to concentrate and multiply water stream energy in underwater hydroelectric turbine applications. Further, there exists a long-felt need in the art for a waterpower stream amplifier device that can be used to concentrate and multiply water stream energy in underwater hydroelectric turbine applications, wherein the device increases the scale and power capacity of underwater hydroelectric turbines.

The present invention, in one exemplary embodiment, is comprised of a waterpower stream amplifier device primarily comprised of a body with an outer surface further comprised of at least one exterior protrusion and an interior surface further comprised of at least one angular flow director. The body is preferably generally conic-shaped, but may be any shape in differing embodiments such as, but not limited to, cylindrical, triangular, square, rectangular, etc. The body is further comprised of at least one central inlet opening that runs from the first end to the second end of the body, wherein the interior surface of the opening is further comprised of at least one angular flow director that may be arranged in a radial and/or spiral fashion around the interior surface. The angular flow director is preferably slightly curved and generally rectangular in shape and may further span the entire length of the interior surface. Once water enters the body through the opening, the flow directors deflect water from horizontal movement in the direction of given rotation caused by the curvature of each flow director.

Water outside the body is further agitated as it passes over the outer surface of the body by at least one, but preferably a plurality of exterior protrusions which are preferably generally triangular in shape. The protrusions may be disposed radially or spirally along the entire outer surface or may only be located on the top surface and bottom surface of the body. Any portion of the outer surface, but preferably the area of the outer surface near the base of each protrusion is further comprised of at least one longitudinal opening that allows water to enter the interior surface of the body from all directions. Therefore, water that is traveling outside of the body tangentially due to the protrusions to enter the body and transfer the momentum of flow into the interior surface. As a result, the direction of movement of the water is changed via the directors from longitudinal horizontal movement to transverse rotational movement, which forms a rotating water vortex within the interior surface as the water travels from the first end towards the second end.

Accordingly, the waterpower stream amplifier device of the present invention is particularly advantageous as it allows hydroelectric power to be used to its full potential by concentrating and multiplying water stream energy in underwater hydroelectric turbine applications. In doing so, the device increases the scale and capacity of underwater hydroelectric turbines. In this manner, the waterpower stream amplifier device overcomes the limitations of existing hydroelectric power generator methods known in the art.

Referring initially to the drawings, FIG. 1 illustrates a side view of one potential embodiment of a waterpower stream amplifier device 100 of the present invention in accordance with the disclosed architecture. The device 100 is primarily comprised of a body 110 with an outer surface 140 further comprised of at least one exterior protrusion 142 and an interior surface 150 further comprised of at least one angular flow director 154. In the preferred embodiment of the device 100, the device 100 is manufactured from a durable metal material such as, but not limited to: steel, stainless steel, aluminum, iron, cast-iron, etc., that may further be corrosion resistant. The body 110 is preferably generally conic-shaped, but may be any shape in differing embodiments such as, but not limited to, cylindrical, triangular, square, rectangular, etc.

Figure 2:
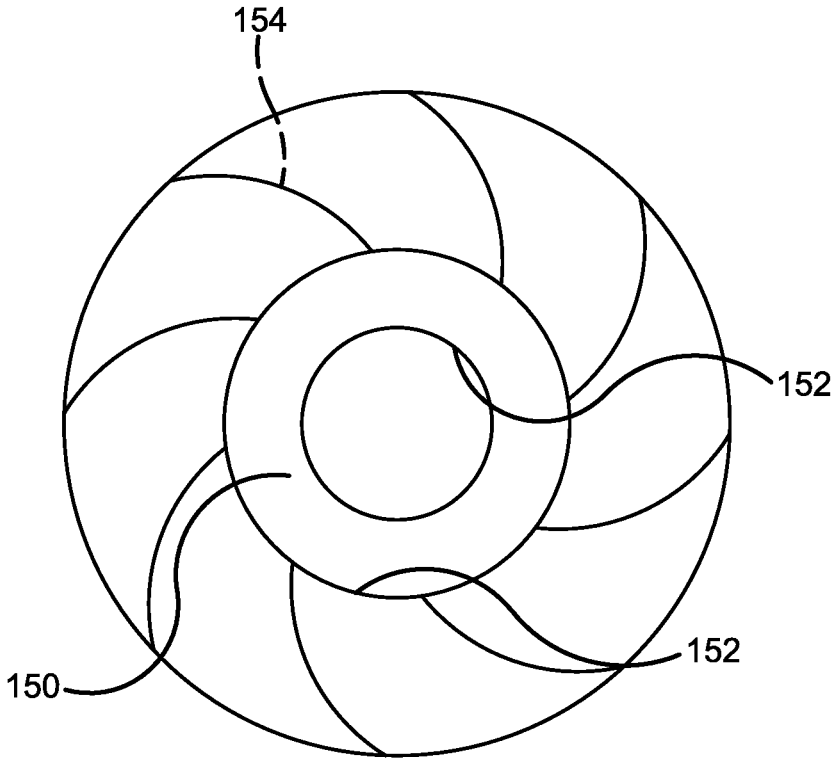
FIG. 2 illustrates a front view of one potential embodiment of a waterpower stream amplifier device of the present invention in accordance with the disclosed architecture.
Figure 3:
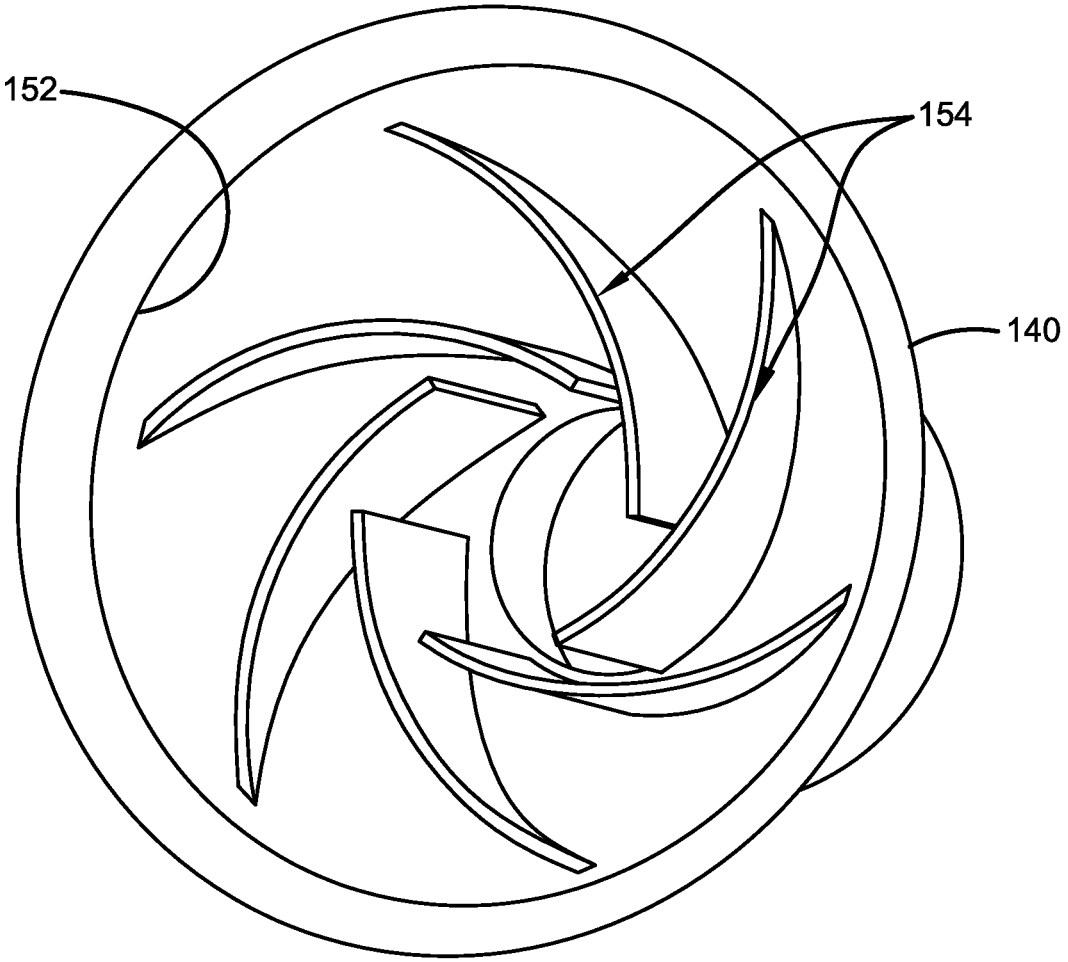
FIG. 3 illustrates a perspective view of one potential embodiment of a waterpower stream amplifier device of the present invention in accordance with the disclosed architecture.

The body 110 is further comprised of at least one central inlet opening 152 that runs from the first end 120 to the second end 130 of the body 110. The opening 152 is preferably round in shape but may be any other shape known in the art such as, but not limited to: square, triangular, oblong, etc. in differing embodiments. The interior surface 150 of the opening 152 is further comprised of at least one angular flow director 154. As best seen in FIG. 2 and FIG. 3, the interior surface 150 preferably has a plurality of angular flow directors 154 that are arranged in a radial and/or spiral fashion around the interior surface 150. Each angular flow director 154 is preferably slightly curved and generally rectangular in shape. However, each flow director 154 may be any shape known in the art such as, but not limited to, square, triangular, circular, etc. Further, the device 100 may have a plurality of flow directors 154, wherein each flow director is of a different or same size, shape, and length. It is further contemplated that each flow director 154 can span the entire length of the interior surface 150 (i.e., along the interior surface 150 from the first end 120 to the second end 130) or only a portion of the interior surface 150. Once water enters the body 110 through the opening 152, the flow directors 154 deflect water from horizontal movement in the direction of given rotation caused by the curvature of each flow director 154.

Figure 4:
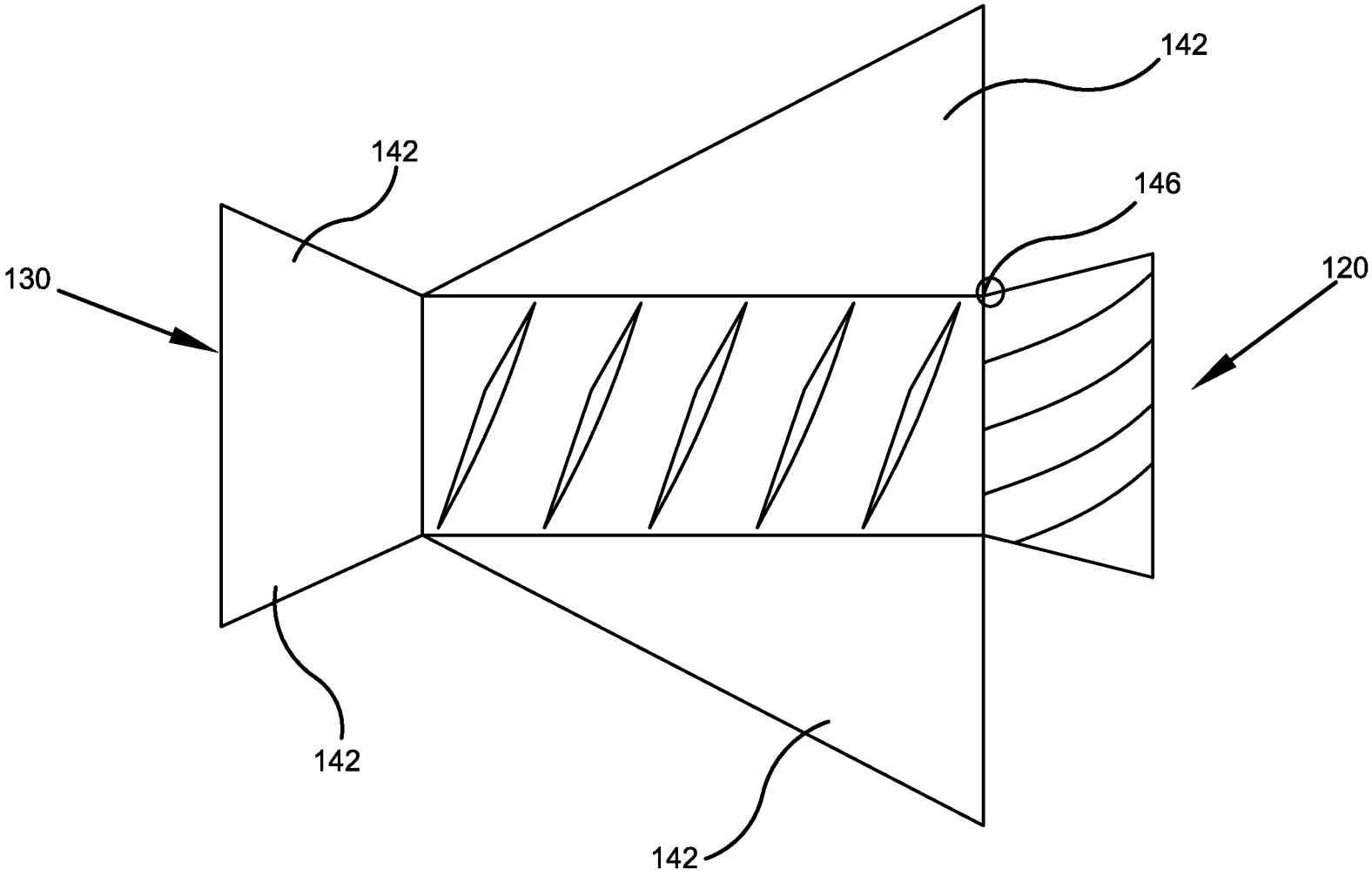
FIG. 4 illustrates a side view of one potential embodiment of a waterpower stream amplifier device of the present invention in accordance with the disclosed architecture.

Water outside the body 110 is further agitated as it passes over the outer surface 140 of the body 110 by at least one, but preferably a plurality of exterior protrusions 142 as seen in FIG. 1 and FIG. 4. The protrusions 142 are preferably generally triangular but may be any shape known in the art in differing embodiments such as, but not limited to, square, rectangular, oblong, etc. The protrusions 142 may further be straight, curved, angled, etc., in differing embodiments. The protrusions 142 may be disposed radially or spirally along the entire outer surface 140 or may only be located on the top surface 112 and bottom surface 114 of the body 110. The protrusions 142 further create a plurality of channels 144 between each protrusion 142. Any portion of the outer surface 140, but preferably the area of the outer surface 140 near the base 143 of each protrusion 142 (or within each channel 144) is further comprised of at least one longitudinal opening 146. The opening 146 allows water to enter the interior surface 150 of the body 110 from all directions, thereby allowing water that is traveling outside of the body 110 tangentially due to the protrusions 142 to enter the body 110 and transfer the momentum of flow into the interior surface 150. When this occurs, the direction of movement of the water is changed via the directors 154 from longitudinal horizontal movement to transverse rotational movement. In this manner, a rotating water vortex is formed within the interior surface 150 as the water travels from the first end 120 towards the second end 130.

During use, the device 100 is placed in front of an underwater hydroelectric turbine. The turbine may have vertical or horizontal rotors, wherein the device 100 increases the kinetic energy of the water entering the rotors by creating a rotational vortex with cross rotation within the interior surface 150. As a result, the power on the rotors of the turbine is increased. Unlike existing forms of hydroelectric power generation that are inefficient, the device 100 converts linear kinetic energy from the flow of water into vortex volumetric rotational motion while preventing negative wall border resistance.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "waterpower stream amplifier device" and "device" are interchangeable and refer to the waterpower stream amplifier device 100 of the present invention.

Notwithstanding the forgoing, the waterpower stream amplifier device 100 of the present invention and its various components can be of any suitable size and configuration as is known in the art without affecting the overall concept of the invention, provided that they accomplish the above-stated objectives. One of ordinary skill in the art will appreciate that the size, configuration and material of the waterpower stream amplifier device 100 as shown in the FIGS. are for illustrative purposes only, and that many other sizes and shapes of the waterpower stream amplifier device 100 are well within the scope of the present disclosure. Although the dimensions of the waterpower stream amplifier device 100 are important design parameters for user convenience, the waterpower stream amplifier device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A waterpower stream amplifier device comprising:

a body further comprised of:

a first end and a second end;

an outer surface with a plurality of triangular exterior protrusions and an opening located adjacent the base of each protrusion;

an interior surface further comprised of a plurality of angular flow directors; and a central inlet opening.

2. The waterpower stream amplifier device of claim 1, wherein the body is conically shaped.

3. The waterpower stream amplifier device of claim 1, wherein the central inlet opening spans from the first end to the second end of the body.

4. The waterpower stream amplifier device of claim 3, wherein the central inlet opening is circular in shape.

5. The waterpower stream amplifier device of claim 1, wherein the plurality of angular flow directors are curved.

6. The waterpower stream amplifier device of claim 1, wherein the plurality of angular flow directors span the length of the interior surface.

7. The waterpower stream amplifier device of claim 1, wherein the plurality of triangular exterior protrusions are disposed spirally or radially along the outer surface.

8. A waterpower stream amplifier device comprising:

a body further comprised of:

a first end and a second end;

an outer surface with a plurality of triangular exterior protrusions and an opening located near the base of each protrusion;

an interior surface; and a central inlet opening, wherein the interior surface is further comprised of a plurality of angular flow directors arranged in a radial fashion around the central inlet opening.

9. The waterpower stream amplifier device of claim 8, wherein the body is conically shaped.

10. The waterpower stream amplifier device of claim 8, wherein the central inlet opening spans from the first end to the second end of the body.

11. The waterpower stream amplifier device of claim 10, wherein the central inlet opening is circular in shape.

12. The waterpower stream amplifier device of claim 8, wherein the plurality of angular flow directors are curved.

13. The waterpower stream amplifier device of claim 8, wherein the plurality of angular flow directors span the length of the interior surface.

14. The waterpower stream amplifier device of claim 8, wherein the plurality of triangular exterior protrusions are disposed spirally or radially along the outer surface.

* * * * *